US005790990A

United States Patent [19]

Hall

[11] Patent Number: 5,790,990

[45] Date of Patent: Aug. 11, 1998

[54] BAPTISTRY WITH INTEGRAL STEP AND STAIRWAY

[76] Inventor: Rocky Hall, P.O. Box 1340, Henderson, Tex. 75653

[21] Appl. No.: 731,089

[22] Filed: Oct. 9, 1996

[51] Int. Cl.[6] ..... E04H 4/00

[52] U.S. Cl. ..... 4/488; 4/506; 4/513

[58] Field of Search ..... 4/488, 496, 506, 4/513, 555, 594, 585, 541.1

[56] References Cited

U.S. PATENT DOCUMENTS

| | | | |
|---|---|---|---|
| D. 251,201 | 2/1979 | Mathis | 4/488 |
| 2,869,140 | 1/1959 | Wiedemann, Jr. . | |
| 3,469,265 | 9/1969 | Bradley . | |
| 4,466,141 | 8/1984 | Starkey | 4/488 |

*Primary Examiner*—David J. Walczak
*Attorney, Agent, or Firm*—Kenneth A. Roddy

[57] ABSTRACT

A church baptistry formed of reinforced polyester material has a main tub area with a bottom wall and contiguous adjoining side walls and end walls extending upwardly from the bottom wall, and at least one integrally formed stairway extending outwardly and upwardly from one or more of the side or end walls. Each stairway has opposed side walls and an inclined bottom wall adjoined at a lower end to the tub area which extends angularly upward and outward therefrom with a flight of steps formed in the inclined bottom wall. At least one lower step is integrally formed in the tub area bottom wall and adjacent side or end wall and extends a distance upwardly from the bottom wall and inwardly a distance into the main tub area beyond the adjacent side or end wall to form a continuation of the flight of steps and may serve as a child's platform. The steps have a tread width greater than the corresponding riser height. In the preferred embodiment, the steps have a tread width of approximately 11" and a riser height of approximately 7". The step arrangement decreases the interior volume which conserves water and reduces the cost for heating it without appreciably increasing the overall dimensions of the baptistry. Optionally the walls of the tub area may have a viewing window, and/or an integral raised platform formed in the bottom wall of the tub area. The tub area may be a generally rectangular, generally T-shaped, generally circular, or generally V-shaped configuration.

16 Claims, 6 Drawing Sheets

BAPTISTRY WITH INTEGRAL STEP AND STAIRWAY

BACKGROUND OF THE INVENTION

1. Field of the Invention

This invention relates generally to church baptistries, and more particularly to a preformed church baptistry having an integral step extending inward into the main tub area and an integral stairway extending outward from the main tub area.

2. Brief Description of the Prior Art

Church baptistries for immersion are commonly installed in a wooden platform structure in the church building. Some baptistries are formed of masonry or metal, and more modern baptistries are molded of fiberglass. Most building codes require that the body of the baptistry tub be supported above a flat surface which will support a minimum of 400 lbs. per square foot. This is usually accomplished by providing a double concrete slab thickness beneath the bottom of the tub body reinforced with #5 reinforcing rods at 12" on centers.

With the advent of molded baptistries, the overall dimensions for various styles of baptistries have become somewhat "standardized". In other words, as a convenience to architects and building designers, the baptistries produced by different manufactures generally have more-or-less standard overall dimensions. However, most prior art "standardized" baptistries have a relatively steep stairway entry wherein the steps have a tread width of about 8½" and a riser height of about 8½". The narrow tread width and the tread width to riser height ratio make entry into and exit from the baptistry uncomfortable and hazardous.

Many of the wooden platforms and concrete foundations beneath the platforms in older church buildings have been designed around the "standardized" overall dimensions of baptistries which have the steep stairway. When replacing an old baptistry with a new one, or when installing a new baptistry in an older church building, it often becomes necessary to remodel or reconstruct the existing wooden platform or to modify the existing concrete slab to meet building code requirements and/or to accommodate the size and fill weight of a newer baptistry having different dimensions from the old one.

Therefore, the need exists for a preformed church baptistry which has a safer more comfortable step arrangement and for a preformed baptistry which can be installed in existing structures on existing foundations with little or no modification of the existing structure or foundation.

There are several patents which disclose various baptistries and stair step arrangements for spas or pools.

Wiedemann, U.S. Pat. No. 2,869,140 discloses a portable baptistry having a rectangular frame which supports an inner liner of waterproof fabric material. There are no steps.

Bradley, U.S. Pat. No. 3,469,265 discloses a baptistry having complementary steps at each end with an adjustable seat between the opposed steps. The lowermost step has an adjustable foot-hold means disposed in a recess whereby the seated person may bend backward without the minister having to support the full body weight of the person being baptized. FIG. 1 of Bradely shows two steps and FIG. 2 shows three steps, all of which are disposed in the main tub area. The steps depicted in the Bradley drawing figures have a tread width which is less than the riser height, thus this step arrangement in a baptistry having a depth of more than two feet would be relatively steep and would make entry into and exit from the baptistry hazardous.

Rinke, U.S. Pat. No. 4,599,835 discloses a molded step assembly for swimming pools which has a pair of side walls and a plurality of steps connected end-to-end. The assembly rests on the bottom of the pool adjacent to the pool side wall. An adjustable adapter step is connected near the top end of the stair frame and overlaps a top rail of the pool side wall, and a pair of handrails extend above the steps on each side.

Rinke, U.S. Pat. No. 4,848,515 discloses a foldable swimming pool step device formed of thermoplastic material which has a pair of stiles interconnected by transverse steps. The stiles are hinged to permit the step structure to be folded into a collapsed position for portability. The steps are adjustable to permit the device to function as an inclined ramp.

The present invention is distinguished over the prior art in general, and these patents in particular by a church baptistry formed of reinforced polyester material having a main tub area with a bottom wall and contiguous adjoining side walls and end walls extending upwardly from the bottom wall, and at least one integrally formed stairway extending outwardly and upwardly from one or more of the side or end walls. Each stairway has opposed side walls and an inclined bottom wall adjoined at a lower end to the tub area which extends angularly upward and outward therefrom with a flight of steps formed in the inclined bottom wall. At least one lower step is integrally formed in the tub area bottom wall and adjacent side or end wall and extends a distance upwardly from the bottom wall and inwardly a distance into the main tub area beyond the adjacent side or end wall to form a continuation of the flight of steps and may serve as a child's platform. The steps have a tread width greater than the corresponding riser height. In the preferred embodiment, the steps have a tread width of approximately 11" and a riser height of approximately 7". The step arrangement decreases the interior volume which conserves water and reduces the cost for heating it without appreciably increasing the overall dimensions of the baptistry. Optionally the walls of the tub area may have a viewing window, and/or an integral raised platform formed in the bottom wall of the tub area. The tub area may be a generally rectangular, generally T-shaped, generally circular, or generally V-shaped configuration.

SUMMARY OF THE INVENTION

It is therefore an object of the present invention to provide a preformed baptistry having a stairway arrangement that affords a safe comfortable entry into and exit from the water.

It is another object of this invention to provide a preformed baptistry having a stairway arrangement that has a bottom step which extends into the tub area and which may also serve as a child's platform on which to stand.

Another object of this invention is to provide a preformed baptistry having a stairway arrangement with steps that have a relatively wide tread width and relatively short riser height without appreciably increasing the overall dimensions of the baptistry.

Another object of this invention is to provide a preformed baptistry having a stairway arrangement with steps that have a relatively wide tread width and relatively short riser height which may be installed in existing structures designed to accommodate baptistries having stairways with steps of narrower tread width and riser height.

A further object of this invention is to provide a preformed baptistry of compact design which conserves water and reduces the cost associated with heating the water.

A still further object of this invention is to provide a preformed baptistry which is simple in construction, economical to manufacture, safe in use, and is attractive in appearance.

Other objects of the invention will become apparent from time to time throughout the specification and claims as hereinafter related.

The above noted objects and other objects of the invention are accomplished by a church baptistry formed of reinforced polyester material having a main tub area with a bottom wall and contiguous adjoining side walls and end walls extending upwardly from the bottom wall, and at least one integrally formed stairway extending outwardly and upwardly from one or more of the side or end walls. Each stairway has opposed side walls and an inclined bottom wall adjoined at a lower end to the tub area which extends angularly upward and outward therefrom with a flight of steps formed in the inclined bottom wall. At least one lower step is integrally formed in the tub area bottom wall and adjacent side or end wall and extends a distance upwardly from the bottom wall and inwardly a distance into the main tub area beyond the adjacent side or end wall to form a continuation of the flight of steps and may serve as a child's platform. The steps have a tread width greater than the corresponding riser height. In the preferred embodiment, the steps have a tread width of approximately 11" and a riser height of approximately 7". The step arrangement decreases the interior volume which conserves water and reduces the cost for heating it without appreciably increasing the overall dimensions of the baptistry. Optionally the walls of the tub area may have a viewing window, and/or an integral raised platform formed in the bottom wall of the tub area. The tub area may be a generally rectangular, generally T-shaped, generally circular, or generally V-shaped configuration.

DESCRIPTION OF THE PREFERRED EMBODIMENT

Figure 1:
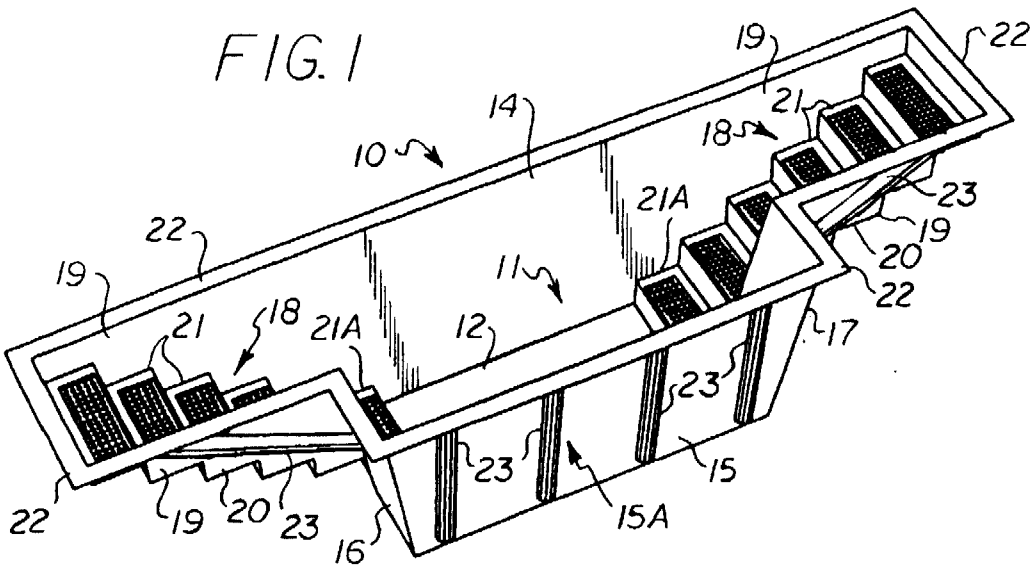
FIG. 1 is a perspective view of a preferred embodiment of the preformed baptistry in accordance with the present invention having a T-shaped configuration.
Figure 3:
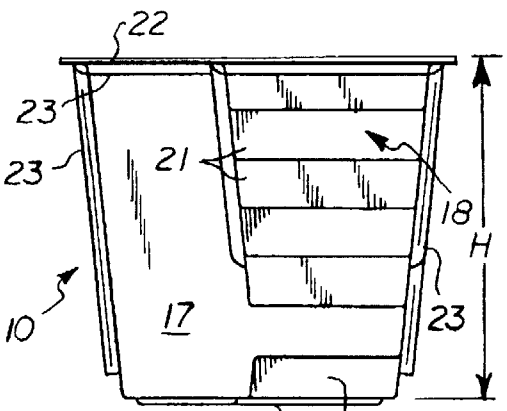
FIG. 3 is an end view of the baptistry of FIG. 1.
Figure 2:
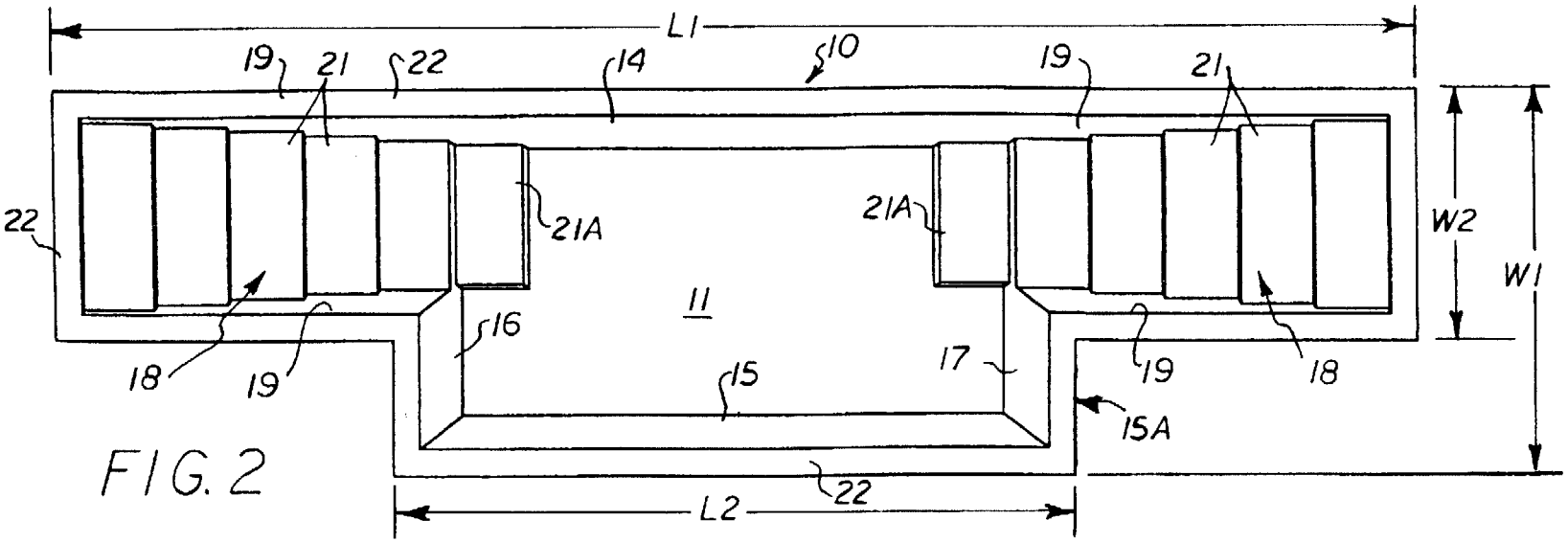
FIG. 2 is a top plan view of the baptistry of FIG. 1.

Referring now to FIGS. 1, 2, 3, and 4 of the drawings, there is shown a preformed baptistry 10 in accordance with one preferred embodiment of the present invention. The preferred baptistry is formed of layers of fiberglass reinforced polyester having a flexural strength in the range of from 18,000 to 29,000 psi., a tensile strength in the range of from 10,000 to 14,000 psi., and a compressive strength in the range of from 18,000 to 27,000 psi.

In the embodiment of FIGS. 1–4, the baptistry 10 is a generally T-shaped configuration having a main body portion or main tub area 11 with a bottom wall, opposed side walls 14 and 15 which extend upwardly from the bottom wall, and opposed end walls 16 and 17 which extend angularly upward and outward from the bottom wall. One side wall 15 of the baptistry 10 has an offset central portion 15A, which extends outwardly perpendicular to the longitudinal axis of the baptistry.

An integrally formed stairway 18 (described in detail hereinafter) extends outwardly and upwardly from the end walls 16 and 17. Each stairway 18 has opposed side walls 19 and an inclined bottom wall 20 adjoined at a lower end to the tub area which extends angularly upward and outward therefrom with a flight of steps 21 formed in the inclined bottom wall 20 of the stairway. A peripheral flange or lip 22 surrounds the open top end of the baptistry and extends radially outward a distance therefrom.

In the T-shaped embodiment, the overall length L1 between the opposed ends is in the range of from about 12'-7" to about 17'-4", and the overall length L2 of the offset central portion is in the range of from about 5'-8" to about 8'-8". The overall width W1 is in the range of from about 4'-6" to about 4'-10", and the overall width W2 of the stairway portion is about 3'-2". The inside dimension or height H of the baptistry is in the range of from about 3'-6" to about 4'-0". It is recommended that the water level of a filled baptistry be six inches from the top. T-shaped baptistries in the recited size ranges have a water capacity of from about 800 gallons for the smaller size to about 1050 gallons for the larger size.

Figure 5:
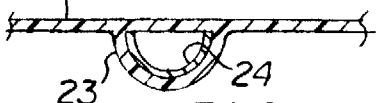
FIG. 5 is a transverse cross sectional view through a reinforcing structural support element of the baptistry taken along line 5—5 of FIG. 4.

As best seen in FIG. 5, the side walls, bottom walls, and lip of the baptistry are reinforced with rigid structural supports 23 to provide extra stiffness and prevent warping and buckling of the walls when the baptistry is filled with water. The structural supports are formed of elongate semicylindrical elements 24 of stiff material which are integrally formed into the laminate.

Figure 4:
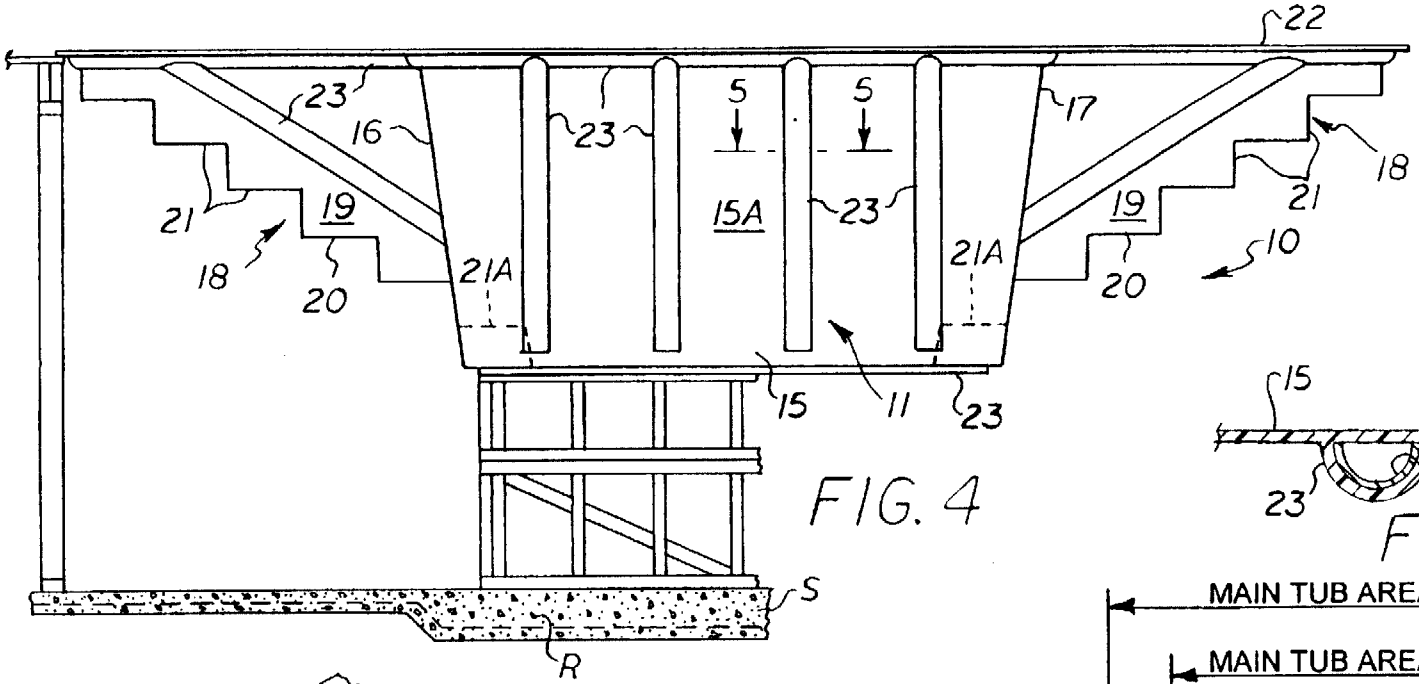
FIG. 4 is a side elevation of the baptistry of FIG. 1, one side of which is shown in cross section supported above a concrete slab.

As seen in FIG. 4, the main tub area 11 of the baptistry is supported on a concrete slab S of double thickness reinforced with reinforcing rods R to support the weight of the baptistry when filled with water.

One of the important features of the present baptistry is the stairway arrangement. In order to more clearly illustrate the significant differences and advantages of the present stairway arrangement, a brief discussion of the prior art stairway follows.

Figure 6:
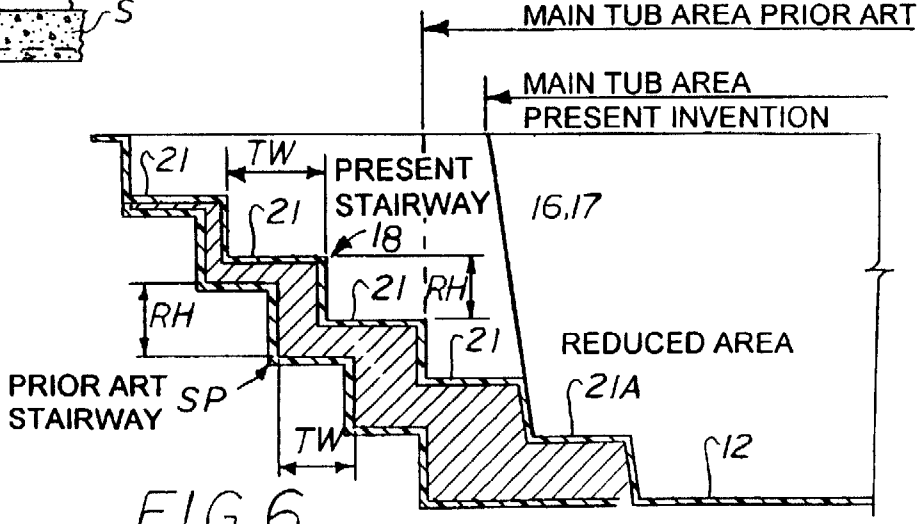
FIG. 6 is a longitudinal cross section of the baptistry stairway in accordance with the present invention superposed on a typical stairway of a prior art baptistry.

Referring now to FIG. 6, the stairway 18 of the present baptistry is shown, somewhat schematically, in cross section superposed on a typical stairway SP of a prior art baptistry. The present stairway 18 is the upper profile and the prior art stairway SP is the lower profile. The typical prior art baptistry has relatively steep stairway SP wherein the steps typically have a tread width TW of approximately 8½" and a riser height RH of approximately 8½", and the steps terminate at their lower end at the side wall of the main tub area of the baptistry. The steeper stairway and narrow tread width and riser height make entry into and exit from the prior art baptistry hazardous and uncomfortable.

In contrast, the stairway 18 of the present baptistry has a stair arrangement that affords a more safe and comfortable entry into and exit from the water. As shown in the upper profile, the steps 21 of the present baptistry have a tread width TW of approximately 11" and a riser height RH of aproximately 7". This arrangement produces a longer, less steep stairway. In the illustrated embodiment, five steps are shown, however, in the longer and taller models, six steps may be provided.

To accommodate the longer stairway 18, the lowermost step 21A extends a distance inwardly into the main tub area 11 of the baptistry along its bottom wall 12. The top surface of the lowermost step 21A is approximately 6" to 7" above the bottom surface 12 of the tub area, depending upon the height of the baptistry. As best seen in FIG. 1, the top surface of each step is provided with a slip-resistant surface, such as a raised disk pattern. The longer stairway and inwardly extending lower step arrangement affords a safe comfortable entry into and exit from the water, which is especially advantageous for older or handicapped individuals and children.

By extending the upper portion of the longer stairway outwardly of the main tub area and extending the lower portion inwardly into the interior of the tub area, the overall exterior dimensions of the present baptistry are not appreciably increased over prior art baptistries, so that the present baptistry may be installed in existing structures which were originally designed to accommodate baptistries having stairways with steps of narrower tread width and riser height. Thus, in most installations in older structures, it is not necessary to substantially reconstruct the existing opening or the existing wooden platform or to modify the existing concrete slab to accommodate the present baptistry.

Another significant advantage of extending the lowermost step 21A a distance inwardly into the main tub area is that the lowermost step also serves as a child's platform on which to stand.

By maintaining the compact overall outer dimensions of the baptistry, providing steps with a wider tread width and shorter riser height, and extending the lower portion of the longer stairway inwardly into the interior of the tub area beyond the end wall and a distance above the bottom wall, the interior volume of the present baptistry is reduced compared to prior art baptistries of the same overall size. As seen in FIG. 6, the area which has been reduced is represented by the diagonal cross hatching. Thus, the smaller interior volume of the present baptistry conserves water and reduces the cost associated with heating the water.

Figure 7:
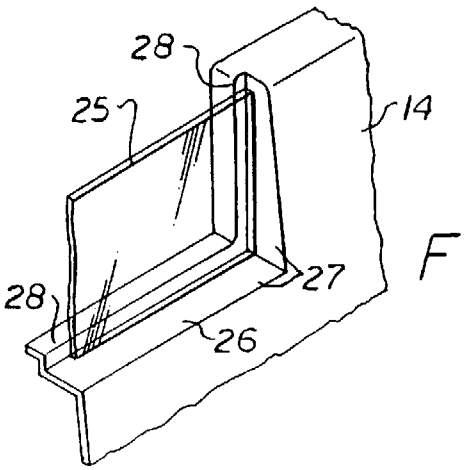
FIG. 7 is a perspective view of a viewing window installed in the side wall of the present baptistry.

As shown in FIG. 7, either side wall of the baptistry may be provided with a transparent viewing window 25. In this modification one of the side walls has a window ledge molded therein which is a rectangular opening 26 that extends approximately 12" downwardly from the top edge and may be 4' to 6' in length, depending upon the size of the baptistry and length of the side wall. The outward facing side of the rectangular opening 26 is smaller in dimension than the inward facing side to define a ledge 27 on the inward side and a raised peripheral shoulder 28 on the outward facing side. A plexiglas window approximately ½" thick is installed in the rectangular opening 26 and sealed therein in watertight relation with conventional sealing materials.

The present baptistries having the described stairway arrangement may be provided in various other configurations. For example, each of the opposed side walls may be provided with an outwardly extending offset central portion, or the opposed side walls may be symmetrical without any outwardly extending central portion. In all of the various configurations of the present baptistries, the side walls and bottom walls of the baptistries are reinforced with the rigid structural supports 23 integrally formed into the laminate to provide extra stiffness and prevent warping and buckling of the walls when the baptistry is filled with water, and each is provided with the stairway arrangement as described above, with the lowermost step extending a distance inwardly into the main tub area of the baptistry along its bottom wall.

Figure 8:
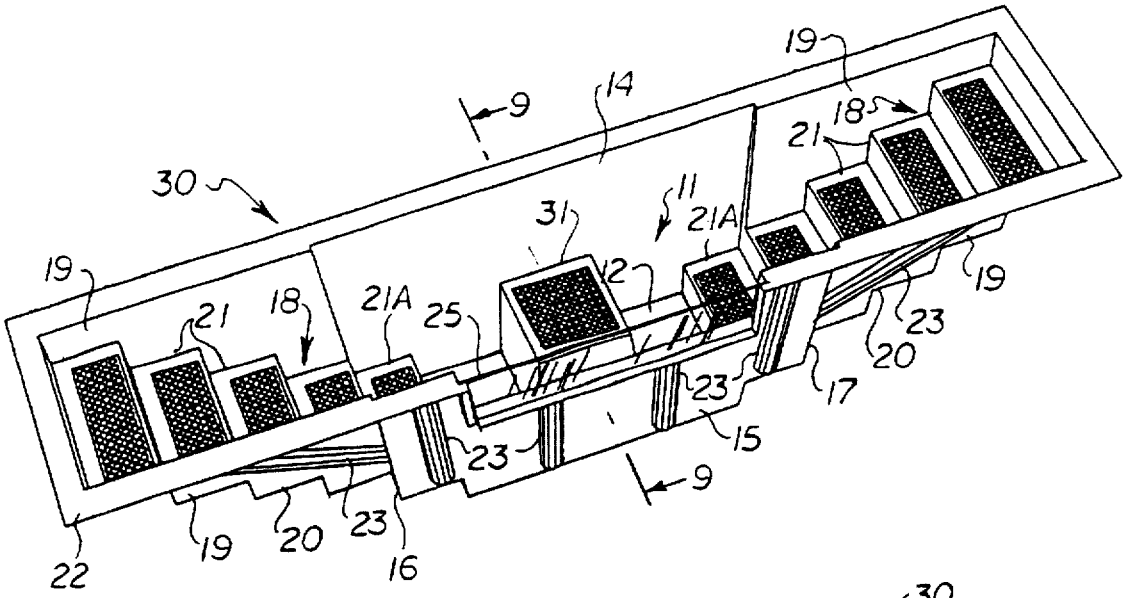
FIG. 8 is a perspective view of an embodiment of the present baptistry having symmetrical side walls, a viewing window, and a raised platform integrally formed in its bottom and side wall.
Figure 9:
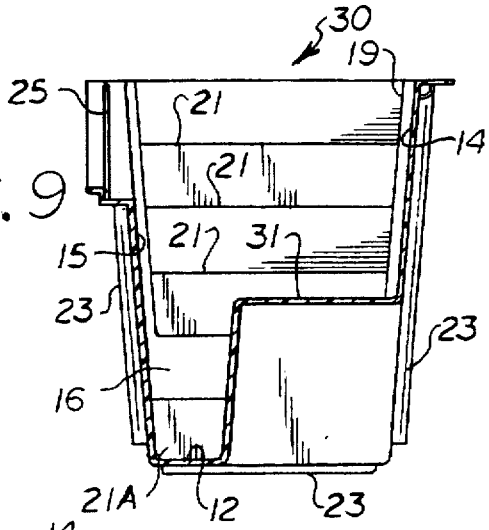
FIG. 9 is a cross section through the integrally formed raised platform taken along line 9—9 of FIG. 8.

FIGS. 8 and 9 show an embodiment of the baptistry 30 having symmetrical side walls 14 and 15 (without the offset), and having a stairway 18 at each end and a viewing window 25 in one side wall 15, as previously described. The details previously described are assigned the same numerals of reference, but their description will not be repeated to avoid repetition. In this embodiment, the main tub area 11 of the baptistry 30 is provided with a raised platform 31 integrally formed in its bottom wall 12. The platform 31 extends upwardly from the bottom wall 12 approximately 1'-6" and approximately 2'-0" inwardly from one side wall 14. The top surface of the platform is provided with a slip-resistant surface, such as raised disk pattern. The platform 31 may be utilized to baptize a person in a seated position rather than a standing position.

Figure 10:
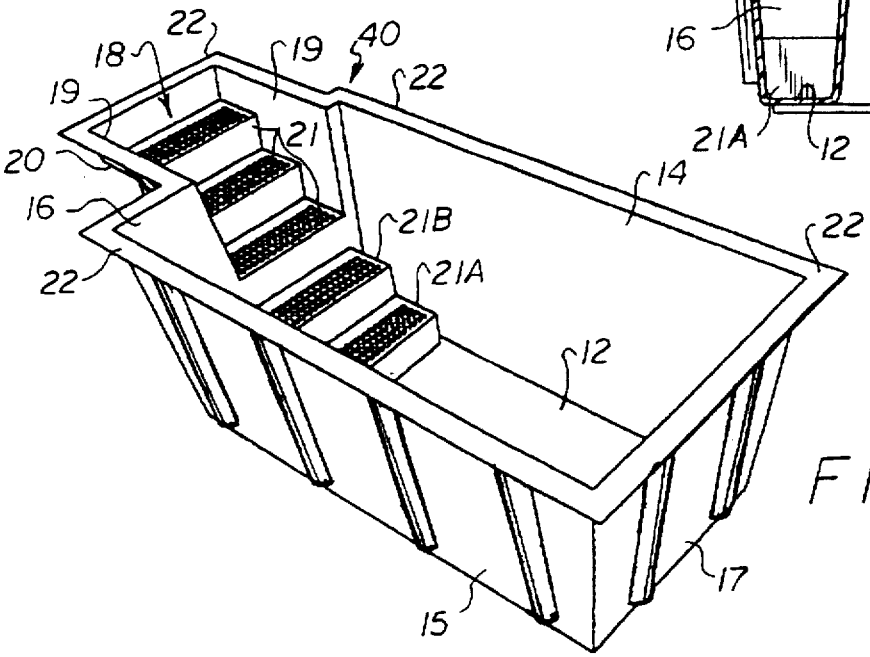
FIG. 10 is a perspective view of an embodiment of the baptistry in accordance with the present invention which has only one stairway and an upwardly extending end wall at the opposite end.
Figure 11:
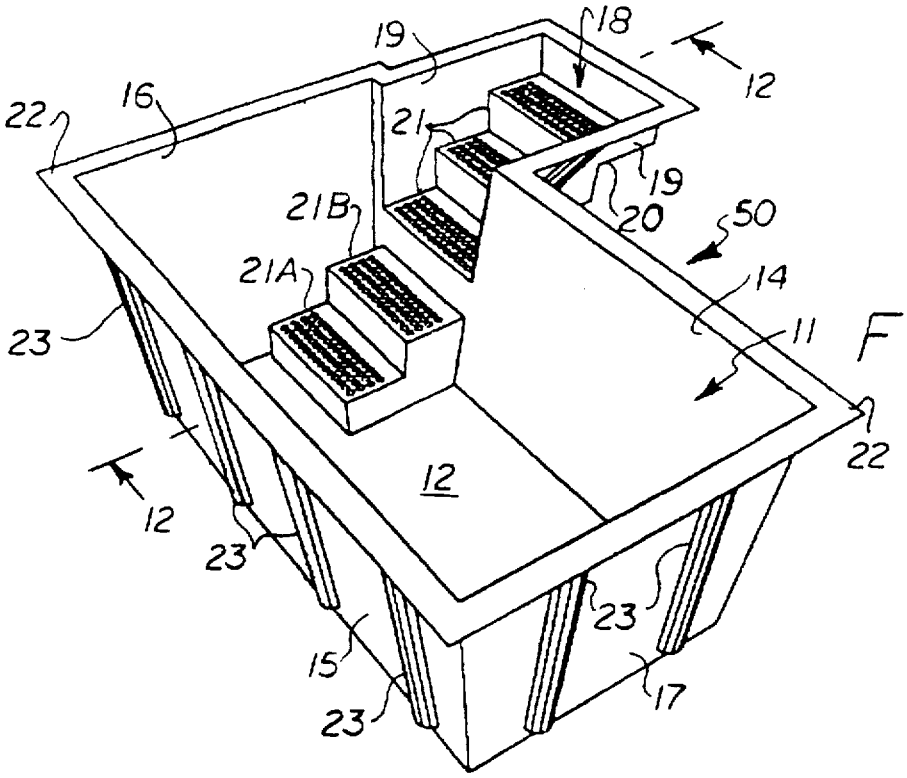
FIG. 11 is a perspective view of an embodiment of the baptistry in accordance with the present invention that has a stairway extending outwardly from a side wall with two lowermost steps integrally formed in the side and bottom walls which extend inwardly into the main tub area.
Figure 12:
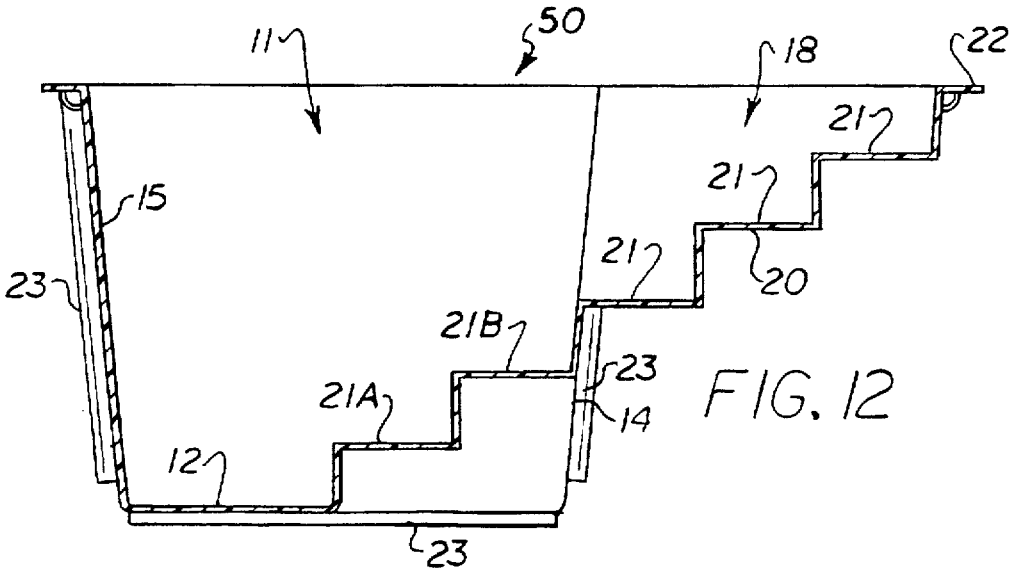
FIG. 12 is a cross section through the stairway arrangement taken along line 12—12 of FIG. 11.

FIG. 10 shows a smaller embodiment of the baptistry 40 which has only one stairway 18 at one end and the end wall 17 opposite the stairway extends upwardly from the bottom wall 12. FIGS. 11 and 12 show another embodiment of the baptistry 50 similar to FIG. 10, but with only one stairway 18 extending upwardly from one side, rather than at one end. In the embodiments of FIGS. 10, 11, and 12, the details previously described are assigned the same numerals of reference, but the description of all of the details will not be repeated to avoid repetition.

In the embodiments of FIGS. 10, 11, and 12, the baptistries 40 and 50 have a stairway arrangement 18 similar to that described above, but with two lowermost steps 21A and 21B extending a distance inwardly into the main tub area 11 of the baptistry along its bottom wall 12.

In these embodiments, the main tub area 11 is a generally rectangular configuration having a bottom wall 12, opposed side walls 14 and 15 and opposed end walls 16 and 17 which extend upwardly from the bottom wall. In the baptistry 40 (FIG. 10), the stairway 18 extends upwardly and outwardly from one of the end walls 16. In the baptistry 50 (FIG. 11), the stairway 18 extends upwardly and outwardly from one of the side walls 14. As with the previously described embodiments, the stairway 18 has a pair of opposed side walls 19 and a bottom wall 20 integral with the end wall 16 (FIG. 10) or the side wall 14 (FIG. 11). A peripheral flange or lip 22 surrounds the open top end of the baptistry and extends radially outward a distance therefrom.

As best seen in cross section in FIG. 12, the lower portion of the bottom wall 20 of the stairway 18 adjoins the side wall 14 (or end wall 16, FIG. 10) a distance above the bottom wall 12 of the main tub area 11 and extends upwardly and outwardly therefrom. A series of steps 21 are formed in the bottom wall 20 of the stairway 18. In the illustrated examples, three steps 21 are formed in the angularly extending bottom wall 20. In the lowermost inwardly extending two step arrangement, the portion of the side wall 14 (or end wall 16) of the main tub area 11 which is beneath the juncture of the angular bottom wall 20 of the stairway extends inwardly into the main tub area 11 and two steps 21A and 21B are molded in the inwardly extending portion and form an extension of the stairway. As with the previously described stairway, the lowermost inwardly extending two step arrangement of the baptistries 40 and 50 have a tread width TW of approximately 11" and a riser height RH of approximately 7".

In these embodiments, the generally rectangular main tub area 11 has an overall length of about 8'-8", an overall width of about 4'-10", and the overall width of the stairway portion is about 3'-2". The inside dimension or height H of the baptistry is about 3'-6". The stairway portion 18 extends outwardly from the side wall or end wall about 2'-8".

In FIG. 10 the stairway 18 is shown in a position closely adjacent one side wall, and in FIG. 11 it shown closely adjacent one end wall, however, it should be understood that the stairway 18 may be positioned near either side wall or near either end wall or may be centered between the opposed side wall or opposed end walls. The stairway 18 may also extend from both end walls as described previously.

Figure 12A:
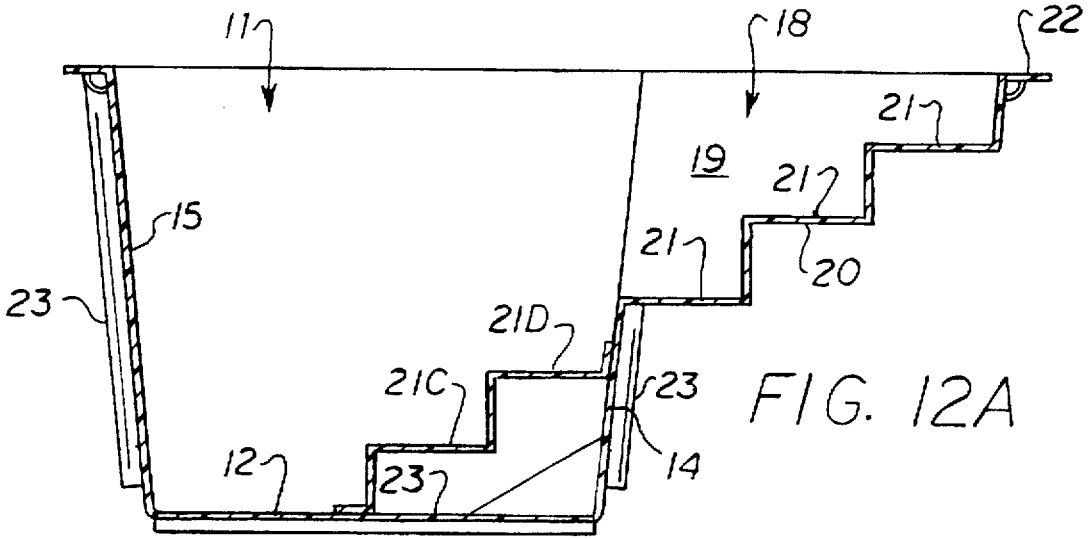
FIG. 12A is a cross section similar to FIG. 12 showing an alternate lower step arrangement.

FIG. 12A is a cross section similar to FIG. 12 showing an alternate lower step arrangement. In this arrangement, the lower portion of the bottom wall 20 of the stairway 18 adjoins the side wall 14 (or end wall 16) a distance above the bottom wall 12 of the main tub area 11 and extends upwardly and outwardly therefrom and a series of steps 21 are formed in the bottom wall 20 of the stairway 18, as previously described. In the example of FIG. 12A, the portion of the side wall 14 (or end wall 16) of the main tub area 11 beneath the juncture of the angular bottom wall 20 of the stairway extends upwardly, and the two lowermost steps 21C and 21D are molded as a separate unit and are then secured by conventional fiberglass fastening means, such as laminating with fiberglass cloth, brackets, etc., to the upwardly extending portion of the side wall 14 (or end wall 16) to form an extension of the stairway. As with the previously described stairway, the steps of the lowermost inwardly extending two step arrangement have a tread width TW of approximately 11" and a riser height RH of approximately 7". It should be understood that the separate two-step unit may also be removably installed in the main tub area.

Figure 13:
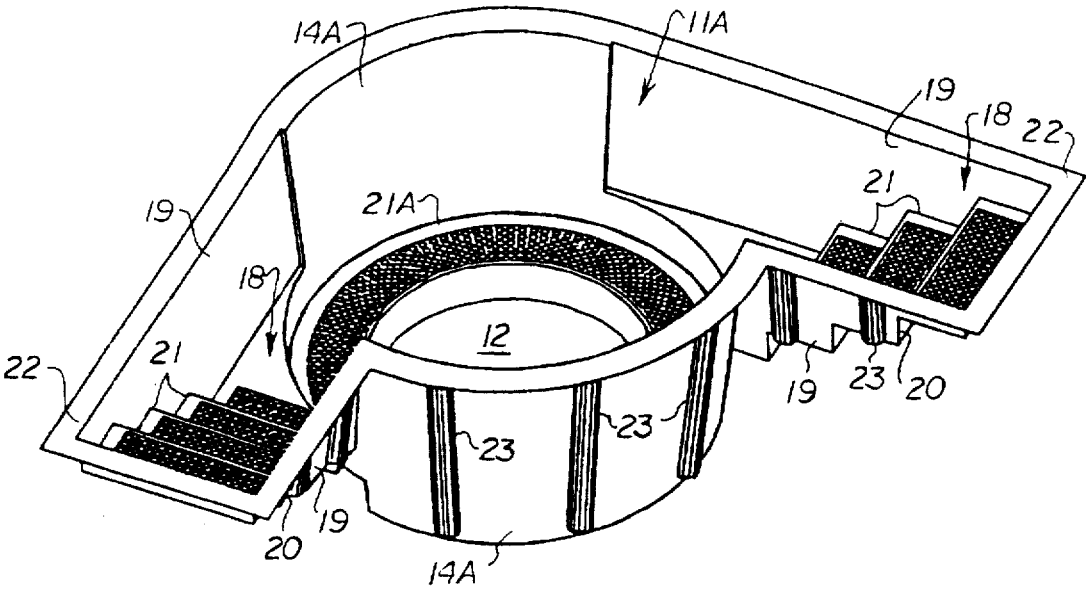
FIG. 13 is a perspective view of an embodiment of the baptistry in accordance with the present invention which has a circular main body with two stairways.
Figure 14:
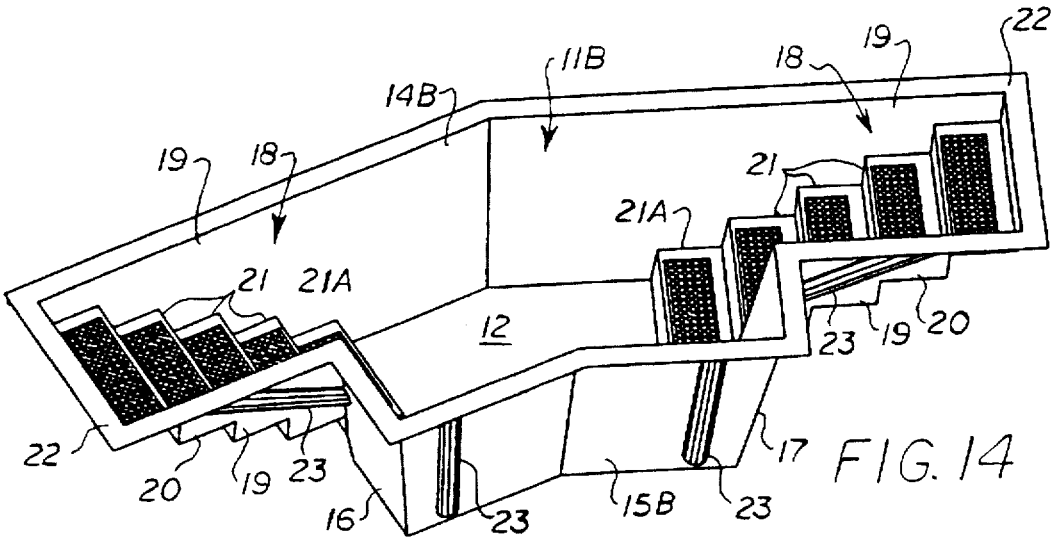
FIG. 14 is a perspective view of an embodiment of the baptistry in accordance with the present invention which has an angular V-shaped main body with two stairways.

The main tub area of the present baptistries may also be a circular configuration 11A having a single upstanding side wall 14A as shown in FIG. 13, wherein one or two stairways 18, as previously described extend tangentially outward from the circular main tub area 11A. The main tub area of the baptistries may also be an angular generally V-shaped configuration 11B with opposed V-shaped side walls 14B and 15B as shown in FIG. 14. In these embodiments, the side walls and bottom walls of the baptistries are also reinforced with the rigid structural supports 23 integrally formed into the laminate to provide extra stiffness and prevent warping and buckling of the walls when the baptistry is filled with water, and each is provided with the stairway arrangement as described above, with the lowermost step extending a distance inwardly into the main tub area of the baptistry along its bottom wall. In the circular configuration of FIG. 13, the lowermost step is a semi-circular ledge configuration which also serves as a child's platform.

While this invention has been described fully and completely with special emphasis upon preferred embodiments, it should be understood that within the scope of the appended claims the invention may be practiced otherwise than as specifically described herein.

I claim:

1. A church baptistry for immersion comprising:

an enclosure having a bottom wall and opposed contiguous adjoining straight side walls and end walls extending upwardly from said bottom wall defining a generally rectangular main tub area for containing a volume of water;

at least one interior lower step disposed in said generally rectangular main tub area integrally formed at the juncture of said bottom wall and at least one of said straight end walls having a horizontal tread portion extending a distance inwardly from said straight end wall into said main tub area and a vertical riser portion extending a distance vertically upwardly from said bottom wall;

a stairway having a pair of laterally opposed straight side walls adjoined to said at least one straight end wall extending outwardly from said generally rectangular main tub area, and a contiguous inclined bottom wall adjoined at a lower end to said at least one straight end wall adjacent said at least one lower step extending angularly upward and outward therefrom;

flight of exterior steps formed in said stairway inclined bottom wall extending upwardly and outwardly from said at least one interior lower step to the exterior of said main tub area, said exterior steps extending transversely between said laterally opposed straight side walls with their ends adjoined thereto; and said at least one interior step and said exterior steps forming a continuous stairway with each of said steps having a tread width greater than the corresponding riser height.

2. The baptistry according to claim 1 wherein said enclosure and said stairway are integrally formed of fiberglass reinforced polyester material with rigid elongate semi-cylindrical structural support elements integrally molded into said main tub area bottom wall and said opposed straight side walls and said stairway laterally opposed straight side walls to provide stiffness and reduce warring and buckling of said walls when said baptistry is filled with water.

3. The baptistry according to claim 1 wherein there are two said interior lower steps disposed in said main tub area integrally formed at the Juncture of said bottom wall and at least one of said straight end walls, said interior lower steps extending a distance inwardly into said main tub area from said at least one straight end wall of said enclosure and forming a continuation of said flight of steps.

4. The baptistry according to claim 1 wherein said flight of exterior steps consists of a series of four exterior steps formed in said stairway inclined bottom wall extending from an upper end to said lower end; and one said interior lower step disposed in said main tub area integrally formed at the juncture of said bottom wall and at least one of said straight end walls, said interior lower step extending a distance inwardly into said main tub area from said at least one side wall of said enclosure.

5. The baptistry according to claim 1 wherein said flight of exterior steps consists of a series of five exterior steps formed in said stairway inclined bottom wall extending from an upper end to said lower end; and one said interior lower step disposed in said main tub area integrally formed at the juncture of said bottom wall and at least one of said straight end walls, said interior lower step extending a distance inwardly into said main tub area from said at least one side wall of said enclosure.

6. The baptistry according to claim 1 wherein said flight of exterior steps consists of a series of four exterior steps formed in said stairway inclined bottom wall extending from an upper end to said lower end; and two said interior lower steps disposed in said main tub area integrally formed at the juncture of said bottom wall and at least one of said straight end walls, said interior lower steps extending a distance inwardly into said main tub area from said at least one side wall of said enclosure.

7. The baptistry according to claim 1 wherein said flight of exterior steps consists of a series of three exterior steps formed in said stairway inclined bottom wall extending from an upper end to said lower end; and two said interior lower steps disposed in said main tub area integrally formed at the Juncture of said bottom wall and at least one of said straight end walls, said interior lower steps extending a distance inwardly into said main tub area from said at least one side wall of said enclosure.

8. The baptistry according to claim 1 further comprising a window opening formed in one of said generally rectangular main tub area opposed straight side walls; and a transparent window sealed in said window opening.

9. The baptistry according to claim 1 wherein further comprising a generally rectangular raised platform disposed in said generally rectangular main tub area integrally formed at the juncture of said bottom wall and at least one of said opposed straight side walls having a horizontal portion extending a distance inwardly from said at least one opposed straight side wall into said main tub area and three contiguous vertical walls extending a distance vertically upwardly from said main tub area bottom wall.

10. The baptistry according to claim 1 wherein there are two said stairways and each said stairway laterally opposed straight side walls and said stairway bottom wall are adjoined to each of said generally rectangular main tub area opposed straight end walls and extend upwardly and outwardly therefrom in opposed relation, and the distance between said generally rectangular main tub area opposed straight side walls is greater than the distance between said stairway laterally opposed straight side walls to define a baptistry having a generally T-shaped configuration.

11. A church baptistry for immersion comprising:

an enclosure having a bottom wall and opposed contiguous adjoining straight side walls and end walls extending upwardly from said bottom wall defining a generally rectangular main tub area for containing a volume of water;

at least one interior lower step disposed in said generally rectangular main tub area integrally formed at the juncture of said bottom wall and at least one of said straight side walls having a horizontal tread portion extending a distance inwardly from said straight side wall into said main tub area and a vertical riser portion extending a distance vertically upwardly from said bottom wall;

a stairway having a pair of laterally opposed straight side walls adjoined to said at least one straight side wall of said main tub area extending outwardly therefrom, and a contiguous inclined bottom wall adjoined at a lower end to said at least one straight side wall adjacent said at least one lower step extending angularly upward and outward therefrom;

a flight of exterior steps formed in said stairway inclined bottom wall extending upwardly and outwardly from said at least one interior lower step to the exterior of said main tub area, said exterior steps extending transversely between said stairway laterally opposed straight side walls with their ends adjoined thereto; and said at least one interior step and said exterior steps forming a continuous stairway with each of said steps having a tread width greater than the corresponding riser height.

12. The baptistry according to claim 11 wherein there are two said stairways and each said stairway laterally opposed straight side walls and said stairway bottom wall are adjoined to one of said opposed side walls of said generally rectangular main tub area and extend upwardly and outwardly therefrom in laterally spaced relation.

13. A church baptistry for immersion comprising:

an enclosure having a bottom wall and a contiguous adjoining circular side wall extending upwardly from said bottom wall defining a generally circular main tub area for containing a volume of water;

at least one interior lower step disposed in said generally circular main tub area integrally formed at the juncture of said bottom wall and said circular side wall having a horizontal tread portion extending a distance inwardly from said circular side wall into said main tub area and a vertical riser portion extending a distance vertically upwardly from said bottom wall;

a stairway having a pair of laterally opposed straight side walls adjoined tangentially to said circular side wall of said main tub area extending outwardly therefrom, and a contiguous inclined bottom wall adjoined at a lower end to said circular side wall adjacent said at least one lower step extending angularly upward and outward therefrom;

a flight of exterior steps formed in said stairway inclined bottom wall extending upwardly and outwardly from said at least one interior lower step to the exterior of said main tub area, said exterior steps extending transversely between said stairway laterally opposed straight side walls with their ends adjoined thereto; and said at least one interior step and said exterior steps forming a continuous stairway with each of said steps having a tread width greater than the corresponding riser height.

14. The baptistry according to claim 13 wherein there are two said stairways and each said stairway laterally opposed straight side walls and said stairway bottom wall are adjoined tangentially to said circular side wall in circumferentially spaced relation and extend upwardly and outwardly therefrom.

15. A church baptistry for immersion comprising:

an enclosure having a bottom wall and contiguous opposed parallel generally V-shaped side walls and straight end walls extending upwardly from said bottom wall defining a generally V-shaped main tub area, as seen from the top, for containing a volume of water;

at least one interior lower step disposed in said generally V-shaped main tub area integrally formed at the juncture of said bottom wall and each of said straight end walls having a horizontal tread portion extending a distance inwardly from said straight end wall into said main tub area and a vertical riser portion extending a distance vertically upwardly from said bottom wall;

a pair of stairways each having a pair of laterally opposed straight side walls adjoined to one of said straight end walls of said main tub area extending outwardly therefrom, and a contiguous inclined bottom wall adjoined at a lower end to said straight side wall adjacent said at least one lower step extending angularly upward and outward therefrom;

a flight of exterior steps formed in each said stairway inclined bottom wall extending upwardly and outwardly from said at least one interior lower step to the exterior of said main tub area, said exterior steps extending transversely between said stairway laterally opposed straight side walls with their ends adjoined thereto; and said at least one interior step and said exterior steps forming a continuous stairway with each of said steps having a tread width greater than the corresponding riser height.

16. A church baptistry for immersion comprising:

an enclosure having a bottom wall and opposed contiguous adjoining straight side walls and end walls extending upwardly from said bottom wall defining a generally rectangular main tub area for containing a volume of water;

at least one interior lower step secured in said generally rectangular main tub area to form an integral lower step at the juncture of said bottom wall and at least one of said straight side walls having a horizontal tread portion extending a distance inwardly from said straight side wall into said main tub area and a vertical riser portion extending a distance vertically upwardly from said bottom wall;

a stairway having a pair of laterally opposed straight side walls adjoined to said at least one straight side wall extending outwardly from said generally rectangular, main tub area, and a contiguous inclined bottom wall adjoined at a lower end to said at least one straight side wall adjacent said at least one lower step extending angularly upward and outward therefrom;

a flight of steps formed in said stairway inclined bottom wall extending from an upper end exterior of said main tub area to said lower end;

a flight of exterior steps formed in said stairway inclined bottom wall extending upwardly and outwardly from said at least one interior lower step to the exterior of said main tub area, said exterior steps extending transversely between said laterally opposed straight side walls with their ends adjoined thereto; and said at least one interior step and said exterior steps forming a continuous stairway with each of said steps having a tread width greater than the corresponding riser height.

* * * * *